US005095679A

United States Patent [19]

Gasser

[11] Patent Number: 5,095,679

[45] Date of Patent: Mar. 17, 1992

[54] COMPOSITE SECTION

[76] Inventor: Erwin Gasser, Via Brunico 21, I-39030 San Lorenzo di Sebato, Italy

[21] Appl. No.: 130,225

[22] Filed: Nov. 12, 1987

Related U.S. Application Data

[63] Continuation-in-part of PCT/EP87/00129, Mar. 5, 1987.

[30] Foreign Application Priority Data

Mar. 12, 1986 [IT] Italy ..... 4810 A/86

[51] Int. Cl.[5] ..... E06B 3/26

[52] U.S. Cl. ..... 52/732; 49/DIG. 1

[58] Field of Search ..... 52/732, 730, 235; 49/DIG. 1, DIG. 2

[56] References Cited

U.S. PATENT DOCUMENTS

| | | | |
|---|---|---|---|
| 2,866,527 | 12/1958 | Schilling | 52/235 |
| 3,517,472 | 6/1970 | Jager | 49/DIG. 1 |
| 4,231,207 | 11/1980 | Kern | 49/DIG. 1 |
| 4,395,862 | 8/1983 | Jager | 49/DIG. 1 |
| 4,896,613 | 1/1990 | Salzer | 49/DIG. 1 |

FOREIGN PATENT DOCUMENTS

| | | |
|---|---|---|
| 3200844 | 7/1983 | Fed. Rep. of Germany . |
| 2073290 | 10/1981 | United Kingdom . |

OTHER PUBLICATIONS

WPO Patent Document 8403326 Aug. 1984, copy 52/TB (10 page of spec.; 3 of drawings).

*Primary Examiner*—John E. Murtagh

*Attorney, Agent, or Firm*—Horst M. Kasper

[57] ABSTRACT

The invention relates to composite sections consisting of a metallic part which is connected, through an intermediate layer of heat-insulating parts, to a non-metallic part. The heat-insulating part is connected rigidly to the non-metallic part but is conneced to the metallic part by positive means and pressure, the pressure providing—while the positively connected parts are approaching each other, at right angles to the longitudinal extent thereof, by plastic deformation of the webs or projections within the corresponding recesses in the heat-insulating part—a clamping action with limited contact areas, whereby limited longitudinal and/or transverse displacements are possible at specific load values in the longitudinal and/or transverse direction (differences in thermal expansion).

1 Claim, 2 Drawing Sheets

COMPOSITE SECTION

CROSS-REFERENCE TO RELATED APPLICATIONS

Figure 1:
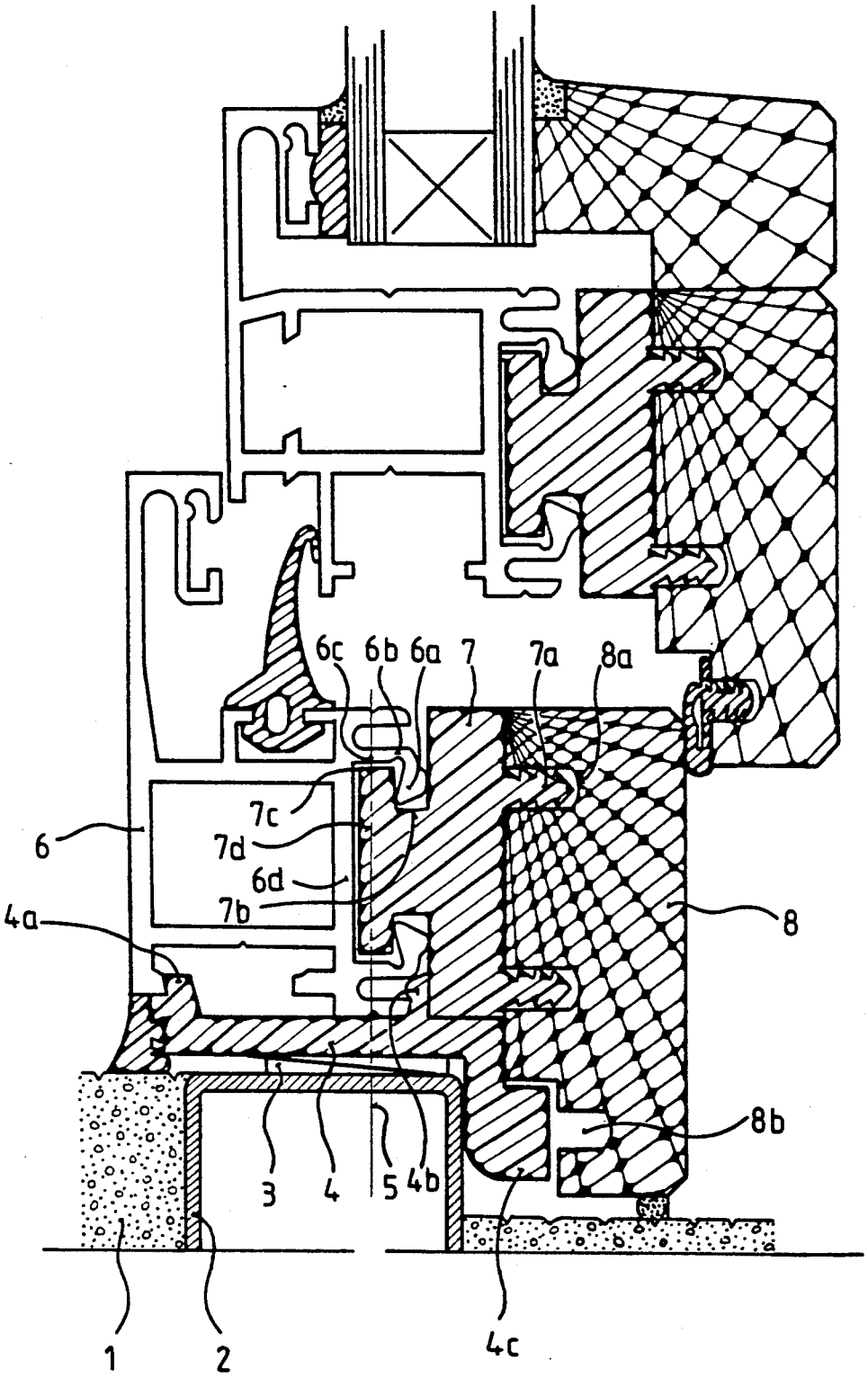

This application is a continuation-in-part application of another international application filed Mar. 5, 1987 under the Patent Cooperation Treaty and bearing application No. PCT/EP87/00129. The entire disclosure of this application, including the drawings thereof, is hereby incorporated in this application as if fully set forth herein.

BACKGROUND OF THE INVENTION

It has long been known, in the manufacturing of sections for windows and doors, to produce composite sections for the purpose of solving various static, aesthetic and/or maintenance problems (German Patent 801 468), or of reducing the transfer of heat between the external and internal parts of window sections (German AS 1 091 735; Austrian Patent 281 384). All of the different assembly systems for composite sections having parts made of the same material, have the disadvantage of becoming distorted, either because of differences in thermal expansion or, in the case of metal-wood sections, because of dimensional fluctuations arising from the absorption of moisture.

These distortions are known to cause sealing problems between frame and casement, as well as cracks at the corners of the frame. It is also known to reduce this distortion by allowing the parts to slide longitudinally in relation to each other.

Although such precautions do nor solve the problem of deformation at the corners of the frames of installed windows and doors, where longitudinal movements cause torque in sections connected at right angles they have the advantage of producing satisfactorily straight composite sections, at least while they are being processed, thus facilitating clean and accurate work.

Another difficulty in the manufacture of composite sections is the fitting and attachment of the connecting element (heat insulation) which is intended to avoid, as far as possible, cold bridges between the parts, to be an optimal insulator, and to ensure parallelism of the parts and dimensional accuracy of the section.

It is known to use, as connecting elements, foamed materials which are fitted by means of devices and arrangements which cover the gaps between parts to be connected until the foamed material has cured (Austrian Patent 281 384; Austrian Patent 322 179). This is also achieved by limited contact-zones between the wood and aluminum parts to be united, although this often leads to blackening of the wood. It is also known to insert plastic strips or sections which engage positively with the parts to be connected (German OS 25 16 753), the strips being locked by resilient deformation in the grooves during insertion. It is also known to connect the parts by processing them from the outside with rollers or other devices, in such a manner as to deform parts of the metal section, but without providing limited sliding between the parts in the longitudinal and/or transverse direction.

It is an object of the present invention to provide a composite section for doors and windows which comprises a heat-insulating and easily applied connecting part. The latter provides limited sliding between the parts in the longitudinal and/or transverse direction, eliminates internal stresses, and is capable of performing functions hitherto assigned to the parts to be connected together.

According to the invention, this is accomplished in that, provided on at least one side of the connection between the section and the connecting element is a positive connection which acts, by plastic deformation, upon webs or clamping projections carried by the metal section. This deformation is achieved by the controlled approach between the metal section and the connecting element itself acting as the deforming tool.

In order to accomplish this, the connecting element comprises at least one longitudinal groove into which tongues or webs on the inserted metal section project. In an angled area, the webs exhibit a cross-sectional reduction for the purpose of establishing a predetermined deformation location, the deformation being obtained by pressing the connecting element transversely against the metal section. According to the invention, the shape of the webs is such that the mutual effect of the groove-surfaces on those of the webs causes clamping of the metal section to the connecting element, as a result of which locking is effected between the elements up to a limited load, either longitudinally or transversely, with play being provided between the parts. After the contact areas between the connected parts have been defined, the locking ensured by friction permits mutual sliding in the longitudinal and transverse directions, as soon as the loads in these direction reach specific values.

According to the invention, the connecting element may be made of extruded PVC, for example, and it may have internal cavities which may, if necessary, be filled with foam. The surfaces of the connecting element which acts upon the clamping webs may, according to the invention, carry a lining or may be processed in such a manner as to achieve the desired strength. According to a further development, the grooves in which the webs engage may also be made of U-shaped sections made of metal for example, also provided with webs, grooves or seats in the general sense, so that other parts forming the composite section may be mounted thereon or secured thereto. According to the invention, the second section, which is connected to the first section by the same connecting element, may be secured in the same way as the first element, it being possible for the clamping to be achieved by a single pressing movement; moreover, this section may be secured in known fashion, e.g. by positive means of various kinds and/or by gluing.

The degree of clamping may be influenced by taking into account the elastic deformation of the clamping elements which precedes the plastic deformation; in this connection, the connecting element may exhibit a shape and structural properties such that the supports are deformed elastically in such a manner that adequate clamping takes place even with partial elastic reverse deformation back to the initial position. This is easily achievable by providing a more or less deep groove in the surface of the connecting element which, during this phase, bears upon the metal section, it being possible for the outer edges, acting as supports, also to be in the form of expanded webs which bend under a certain amount of pressure and thus provide the movement necessary for the remaining deformation of the clamping webs. In relation to the introducing grooves, the cross-section of the clamping webs may be such that, in the clamping position, the outermost tip presses upon the corresponding side of the groove, whereas the rear side is supported by the opposite side of the groove.

Figure 2:
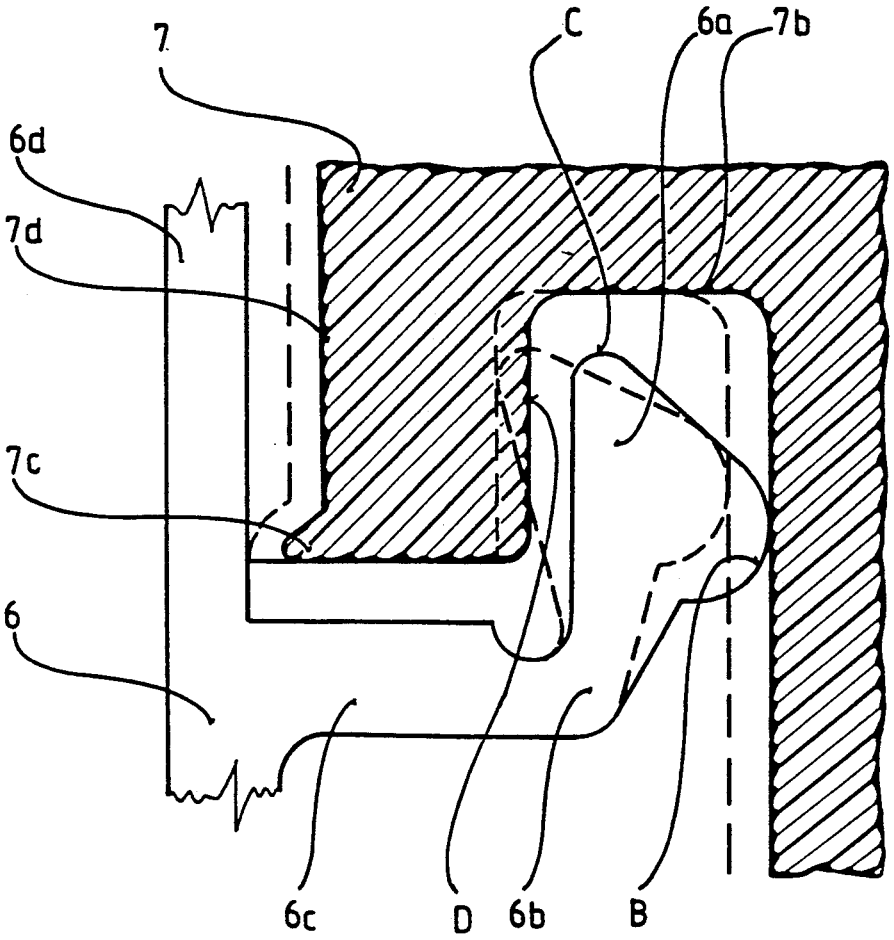

The invention is explained hereinafter in greater detail in conjunction with a preferred embodiment of an aluminum-wood composite section according to the invention shown diagrammatically in the drawing attached hereto which is purely explanatory and in no way restrictive. In the drawing:

FIG. 1 shows a cross-section through an aluminum-wood composite section for window-casements and frames; and FIG. 2 shows in detail the clamping connection between the metal section and the connecting section.

Metal section 6 is snapped, at 4*a* and 4*b*, to frame 2 with an intervening layer of insulation 4, alignment being effected by means of wedge 3; metal section 6 comprises internal webs 6*c* with clamp-ends 6*a* and a cross-sectional reduction 6*b*. Connecting element 7, made of insulating material, is inserted longitudinally between webs 6*c*. Grooves 7*b* correspond to the position of clamp-end 6*a* and the support equipped with a wider groove 7*d* and projections 7*c* at the sides, is directed towards surface 6*d* from which webs 6*c* project. During the controlled approach of these parts in the transverse direction, surface A of element 7 presses against curve B of clamp-end 6*a* latter is bent until area C presses against surface D of the groove, projections 7*c* of connecting element 7 being pressed against surface 6*d* of the metal section. However, because of the play provided, limited sliding is assured transversely of the connected parts.

During this phase of permanent deformation of webs 6*c* by clamp-ends 6*a*, it is possible to provide limited elastic deformation of areas of connecting element 7 located between clamp-ends 6*a* and supporting surface 6*d*, thus compensating for possible elastic restoration of the clamp-ends. This elastic deformation may be made dependent upon the shaping and arrangement of projections 7*c* and groove 7*d*.

The composite sections illustrated in FIG. 1 comprise a wooden lining 8 which is secured by means of grooves 8*a* and anchoring webs 7*a* projecting from connecting element 7.

Seals may be applied in known fashion by means of grooves 8*b* which may, if necessary, resemble anchoring grooves 8*a*. The entire composite section according to the invention, consisting of an aluminum part 6, a plastic part 7, and a wooden part 8 may be thermally insulated from frame 2 and masonry 1 by a plastic part 4 which is snapped, at 4*a* and 4*b*, to aluminum part 6, extension 4*c* thereof also interrupting cold bridges between wood 8 and frame 2.

Since the connection according to the invention does away with the need for adhesive foamed materials and the like, internal stresses due to mutual muted sliding of parts is eliminated. The invention does not eliminate the use of spacing elements comprising the structural and functional characteristics of described connecting element 7.

The embodiments of the invention in which an exclusive property or privilege is claimed are defined as follows:

1. A composite section for windows and doors consisting of a metal section (6) and a non-metallic section (8) joined by means of a plastic connecting section (7), wherein the plastic connecting section, as compared to at least one of the sections to be connected is provided with a tongue and groove joint, a fitting joint being secured longitudinally and transversely by a clamping action of metallic flange-edges (6*a*) of the metal section (6) acting upon the connecting section (7), said flange-edges (6*a*) to be deformed by bending so as to result in a tightly clamped formation on the plastic connecting section (7), said flange-edges (6*a*) adapted to be fitted in one piece with the metal section or to it, characterized in that flanges (6*c*) comprise a rounded rear surface (B) and a crest (C), which project in longitudinal grooves of the connecting section and are formed in such a manner so as to permit at a deformed stage of these flange-edges (6*a*) an allowance (G) in a transverse direction between longitudinal grooves (7*b*) and the crest (C) of the flange-edges (6*a*) and in that the connecting section (7) which co-operate with the crest (C) of the flange-edges (6*a*) is provided in a longitudinal direction with projecting faying-edges (7*c*) which adhere to a faying surface (6*d*) of the metal section (6).

* * * * *